US012310446B2

(12) United States Patent
Klein et al.

(10) Patent No.: US 12,310,446 B2
(45) **Date of Patent: *May 27, 2025**

(54) FOOTWEAR AND SOLE STRUCTURE ASSEMBLIES WITH SPLIT MIDSOLES HAVING PERIPHERAL WALLS FOR LATERAL STABILITY

(71) Applicant: NIKE, Inc., Beaverton, OR (US)

(72) Inventors: Ross Klein, Portland, OR (US); Kort W. Neumann, IV, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/480,766

(22) Filed: Oct. 4, 2023

(65) Prior Publication Data

US 2024/0023666 A1 Jan. 25, 2024

Related U.S. Application Data

(63) Continuation of application No. 17/204,513, filed on Mar. 17, 2021, now Pat. No. 11,805,842.

(60) Provisional application No. 63/008,856, filed on Apr. 13, 2020.

(51) Int. Cl.

| | |
|---|---|
| ***A43B 13/12*** | (2006.01) |
| ***A43B 13/14*** | (2006.01) |
| ***A43B 13/18*** | (2006.01) |

(52) U.S. Cl.

CPC ..... *A43B 13/127* (2013.01); *A43B 13/122* (2013.01); *A43B 13/141* (2013.01); *A43B 13/188* (2013.01)

(58) Field of Classification Search

CPC ... A43B 13/127; A43B 13/122; A43B 13/141; A43B 13/188; A43B 13/181; A43B 13/185; A43B 13/187

See application file for complete search history.

(56) References Cited

U.S. PATENT DOCUMENTS 11,805,842 B2 * 11/2023 Klein ..... A43B 13/127

* cited by examiner

*Primary Examiner* — Bao-Thieu L Nguyen
(74) *Attorney, Agent, or Firm* — Quinn IP Law

(57) ABSTRACT

Presented are footwear sole structures with split midsole designs having peripheral walls for lateral stability, footwear fabricated with such sole structures, and methods for making/using such footwear and/or sole structures. A sole structure for an article of footwear includes mating first and second midsole sections each having a respective midsole sidewall that extends between and adjoins respective upper and lower midsole surfaces. The first midsole section's lower surface has a first waveform geometry, such as an anteroposterior-undulating curviform wave, and the second midsole section's upper surface has a complementary, mirrored waveform geometry that seats therein and intermeshes with the first waveform geometry. The second midsole section includes one or more peripheral walls that extend upward from the second sidewall; inboard surfaces of the peripheral wall(s) abut outboard surfaces the first sidewall. An outsole, which defines the footwear's ground-contacting surface, is attached to the lower surface of the second midsole section.

20 Claims, 4 Drawing Sheets

FOOTWEAR AND SOLE STRUCTURE ASSEMBLIES WITH SPLIT MIDSOLES HAVING PERIPHERAL WALLS FOR LATERAL STABILITY

CLAIM OF PRIORITY AND CROSS-REFERENCE TO RELATED APPLICATIONS

This application is a continuation of U.S. patent application Ser. No. 17/204,513, which was filed on Mar. 17, 2021, is now allowed, and claims the benefit of priority to U.S. Provisional Patent Application No. 63/008,856, which was filed on Apr. 13, 2020. Both of the foregoing patent applications are incorporated herein by reference in their respective entireties and for all purposes.

TECHNICAL FIELD

The present disclosure relates generally to articles of footwear. More specifically, aspects of this disclosure relate to footwear with multilayered sole structures having impact-attenuating midsoles, wear-reducing outsoles, and foot-cushioning insoles.

BACKGROUND

Articles of footwear, such as shoes, boots, slippers, sandals, and the like, are generally composed of two primary elements: an upper for securing the footwear to a user's foot; and a sole for providing subjacent support to the foot. Uppers may be fabricated from a variety of materials, including textiles, polymers, natural and synthetic leathers, etc., that are stitched or bonded together to form a shell or harness for securely receiving a foot. Many sandals and slippers, for example, have an upper with an open toe and/or open heel construction. Some upper designs are limited to a series of straps that extend over the user's instep and, optionally, around the ankle. Conversely, boot and shoe designs employ a full upper with a closed toe and heel construction that encases the foot. An ankle opening through a rear quarter portion of the upper provides access to the footwear's interior, facilitating entry and removal of the foot into and from the upper. A shoelace or strap system may be utilized to secure the foot within the upper.

A sole structure is mounted to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole, which may be located partially or entirely within the upper, is a thin and compressible member that provides a contact surface for the underside "plantar" region of the user's foot. By comparison, the midsole is mounted underneath the insole, forming a middle layer of the sole structure. In addition to attenuating ground reaction forces, the midsole helps to control foot motion and impart enhanced stability during forward and lateral gait. Secured underneath the midsole is an outsole that forms the ground-contacting portion of the footwear. The outsole is usually fashioned from a durable, waterproof material that includes tread patterns engineered to improve traction.

SUMMARY

Presented herein are footwear sole structures with split midsole designs having peripheral walls for lateral stability, articles of footwear fabricated with such sole structures, and methods for making or for using such footwear and/or sole structures. By way of example, and not limitation, there are disclosed basketball shoes and other athletic footwear with a layered sole structure assembly having a multipiece midsole design. For instance, a first (top) half of a split midsole is located, substantially or entirely, inside the upper, whereas a second (bottom) half of the midsole is located, substantially or entirely, outside the upper. Each midsole half may be independently molded as a single-piece structure from a closed-cell, cross-linked polyolefin foam, such as ZOTEFOAM®, e.g., to maximize energy return to users in order to increase endurance. The shoe's upper may be assembled with a textile material that wraps around the side and bottom surfaces of the midsole's top half such that a bottom-most portion of the textile material is sandwiched between and rigidly attached to the two halves of the midsole. A ground-engaging outsole formed from a durable synthetic rubber may be overlaid onto a downward facing, underside surface of the midsole's bottom half. An optional foot-cushioning insole is laid on the top half of the midsole, located entirely inside the shoe upper.

To optimize cushion feel and energy return, the multipiece midsole assembly may adopt a "tall midsole" concept that is typified by, for example, a total midsole height that is about 30-40% larger than many conventional midsole designs. Increasing the midsole height concomitantly increases the height of the shoe structure's center of gravity; to offset inadvertent foot eversion and inversion during lateral gait, the multipiece midsole incorporates numerous stability-enhancing features. As one example, the two midsole halves mechanically interlock with one another via an anteroposterior-undulating waveform bottom surface of the top half seating against and intermeshing with a complementary mirrored top surface of the midsole's bottom half. In addition, a textile "rebar" sheet—be it a dedicated scrim, a strobel, a portion of the upper, etc.—may be interposed between and cover both interfacing surfaces of the midsole's top and bottom halves.

Midsole constructions comparable to those that are presently disclosed are described, for example, in International Application No. PCT/US2018/048562 ("'562 Application), which claims priority to U.S. Provisional Patent Application No. 62/552,905, both of which are incorporated herein by reference in their respective entireties and for all purposes. In some applications, particularly those that involve sharp lateral motions/cutting (e.g., basketball or tennis), the designs listed in the '562 Application may provide less lateral support than may be desired by an athlete. This lateral support concern may be further exacerbated by the relatively tall stack-height of the sole structure that may be needed for ideal energy return and cushioning, e.g., for running and jumping.

In the presently disclosed designs, additional lateral support may be provided by integrally formed peripheral walls that extend vertically upwards from the sidewalls of the midsole's bottom half. This midsole bottom half may be fabricated with a single peripheral wall, such as a single wall that extends continuously around the upper perimeter of the midsole half, or multiple spaced peripheral walls, such as a first (forefoot) peripheral wall section that extends around the shoe's toe box in the shoe's forefoot region and a second (hindfoot) peripheral wall section that extends around the heel counter in the shoe's hindfoot region. Inboard surfaces of these peripheral walls seat flush against complementary sidewalls of the midsole top half to provide lateral support for the upper half while also covering some or all of the wave seam extending across the midsole. Outsole sidewalls may be formed with optional peripheral walls that extend upwards therefrom and abut select portions of the midsole's peripheral walls to provide further mediolateral reinforcement.

A unique last design, composed of a standard (amorphous) foot-shaped last that is encased within a snap-lock outer shell, may be used to assemble any of the herein described footwear. During shoe manufacture, for example, the individual footwear elements are independently constructed and assembled together on the last. The two halves of the bipartite midsole may be injection molded from a polymer foam; the upper and top midsole half are then sheathed onto the mechanical last. An optional insole may then be inserted into the upper and seated on a top surface of the top midsole half. To complete the final lasting processes, the outsole and bottom midsole half are retained against the upper and top midsole half by snapping together the two halves of the outer shell over the last.

Aspects of this disclosure are directed to footwear sole structures with multipiece midsoles having vertical peripheral walls for increased lateral stability. In an example, a sole structure for an article of footwear includes a first (top) midsole section, a second (bottom) midsole section, an outsole secured to the bottom of the midsole, and an optional insole seated on top of the midsole. Each of the midsole sections includes a respective midsole sidewall that extends between and adjoins respective opposing upper and lower surfaces. The lower surface of the first midsole section has a first waveform geometry, and the upper surface of the second midsole section has a second waveform geometry that seats therein and intermeshes with the first waveform geometry of the first midsole section. One or both of the midsole sections also includes one or more peripheral walls that extend upward/downward from that midsole's sidewall. Inboard surfaces of each peripheral wall abuts outboard surfaces of the opposing midsole section's sidewall. The outsole, which rigidly attaches to the second midsole section's lower surface, defines the footwear's ground-contacting surface.

Further aspects of this disclosure are directed to athletic shoes and other footwear fabricated with any of the disclosed multilayer sole structure assemblies. As an example, an article of footwear is presented that includes an upper designed to receive and attach to a foot of a user, and a sole structure that is attached to the upper and designed to support thereon the user's foot. An outsole, which is rigidly mounted to a lower surface of the midsole, is fabricated with a ground-contacting surface of the footwear. An optional insole, which is seated on a top surface of the midsole inside the upper, is fabricated with a foot sole-contacting surface of the footwear. The sole structure is composed of a first midsole section with a first sidewall extending between and adjoining opposing first upper and lower surfaces, and a second midsole section with a second sidewall extending between and adjoining opposing second upper and lower surfaces. The first midsole section's lower surface has a first waveform geometry, and the second midsole section's upper surface has a second waveform geometry that seats therein and intermeshes with the first waveform geometry. The second midsole section is fabricated with one or more peripheral walls that extend upward from the second sidewall and abut medial, lateral, and end surfaces of the first midsole section's sidewall.

Additional aspects of this disclosure are directed to methods for manufacturing and methods for using any of the disclosed footwear and/or sole structures. In an example, a method is presented for constructing a sole structure for an article of footwear. This representative method includes, in any order and in any combination with any of the above and below disclosed features and options: forming, using a first polymer foam material, a first midsole section including opposing first upper and lower surfaces and a first sidewall extending between and adjoining the first upper and lower surfaces, the first lower surface having a first waveform geometry; forming, using a second polymer foam material, a second midsole section including opposing second upper and lower surfaces and a second sidewall extending between and adjoining the second upper and lower surfaces, the second upper surface having a second waveform geometry; the first and/or second midsole section including a peripheral wall extending upward/downward from the midsole sidewall; seating the first midsole section on the second midsole section with the second waveform geometry intermeshing the first waveform geometry of the first midsole section and the peripheral wall abutting the first sidewall; and attaching an outsole to the second lower surface of the second midsole section, the outsole including a ground-contacting surface of the article of footwear.

For any of the disclosed footwear, sole structures, and methods, the peripheral wall of the second midsole section may include a first peripheral wall that projects upward from a forefoot region of the second sidewall, and a second peripheral wall that is spaced from the first peripheral wall and projects upward from a hindfoot region of the second sidewall. The first peripheral wall may have a first arcuate shape that extends from a medial side to a lateral side of the second midsole section, around a toe box region of the first midsole section. Likewise, the second peripheral wall has a second arcuate shape that is distinct from the first arcuate shape and extends from the medial side to the lateral side of the second midsole section, around a heel counter region of the first midsole section. The first peripheral wall may include a first medial wall section, a first lateral wall section that is distinctly shaped from the first medial wall section, and a toe wall section that extends between and adjoins these medial and lateral wall sections. In this regard, the second peripheral wall may include a second medial wall section, a second lateral wall section that is distinctly shaped from the second medial wall section, and a heel wall section that extends between and adjoins these medial and lateral wall sections.

For any of the disclosed footwear, sole structures, and methods, the outsole may include one or more flanged peripheral walls that extend upward from select segments of the outsole's perimeter. An inboard surface of the outsole's flanged peripheral wall(s) abuts an outboard surface of the second midsole section's peripheral wall(s). As another option, a flexible sheet may be interposed between the first and second midsole sections, extending across and covering the first lower surface and the second upper surface. This flexible sheet may wrap around, contact, and rigidly attach to the first midsole section's sidewall and lower surface such that the first midsole section is nested within the flexible sheet. The flexible sheet may be a dedicated layer of the sole structure, may rigidly attach directly to the footwear's upper, and/or may form a section of the upper.

For any of the disclosed footwear, sole structures, and methods, the first waveform geometry of the first midsole section's lower surface may include a first anteroposterior-undulating curviform wave that extends from fore to aft edges of the first midsole section. Likewise, the second waveform geometry of the second midsole section's upper surface may include a second anteroposterior-undulating curviform wave that extends between fore and aft edges of the second midsole section. These anteroposterior-undulating curviform waves may have complementary, mirrored shapes with damped sinusoidal longitudinal cross sections, respectively, such that the first lower surface sits substantially flush against the second upper surface.

For any of the disclosed footwear, sole structures, and methods, the first midsole section, including any constituent parts thereof, may be molded as a discrete single-piece structure from a first polymer foam. In the same vein, the second midsole section, including any constituent parts thereof, may be molded as a discrete single-piece structure from a second polymer foam, which may be the same as, similar to, or distinct from the first polymer foam. A compressible insole may be seated in a complementary pocket that is recessed into the first midsole section's upper surface. The first and second polymer foams may be the same cross-linked polyolefin foam. The compressible insole may be fabricated from a third polymer foam that is distinct from the polymer foam(s) used to form the midsole sections. The outsole may be fabricated from a polymer material that is harder than any of the foregoing polymer foam materials.

This summary does not represent every embodiment or every aspect of the present disclosure. Rather, the foregoing summary merely provides an exemplification of some of the novel concepts set forth herein. The above features and advantages, and other features and attendant advantages of this disclosure, will be readily apparent from the following detailed description, illustrated examples, and representative modes for carrying out the disclosure when taken in connection with the accompanying drawings and the appended claims. Moreover, this disclosure expressly includes any and all combinations and subcombinations of the elements and features presented above and below.

Figure 1A:
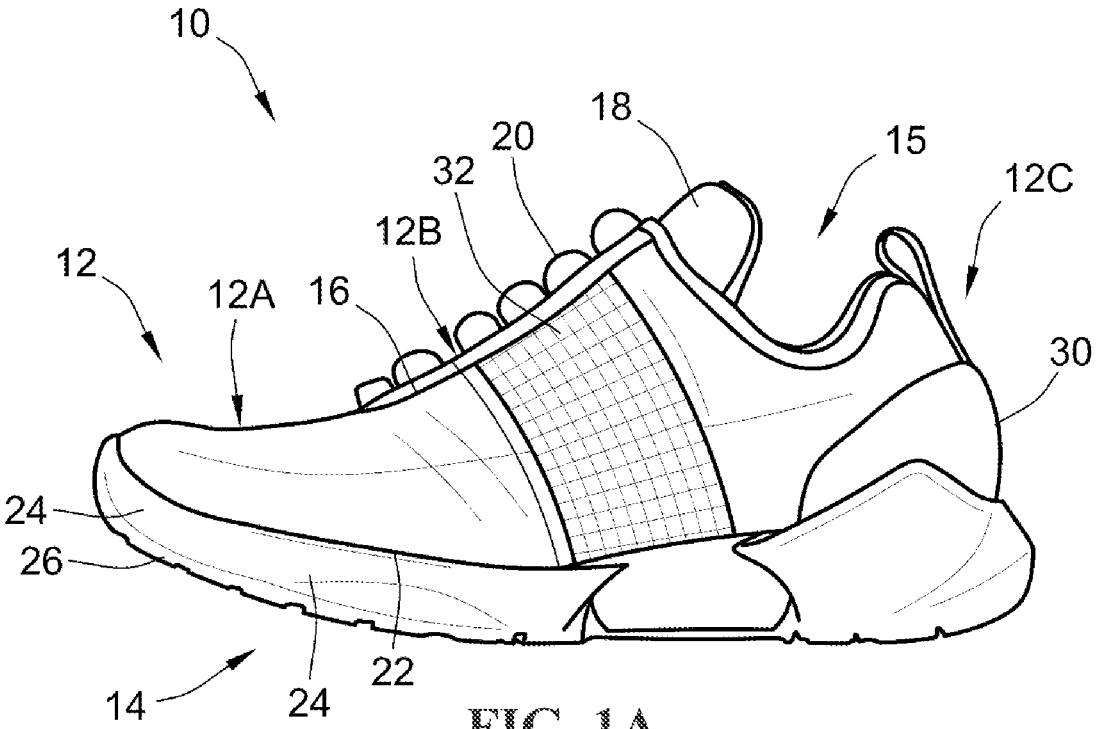
FIG. 1A is a lateral, side-view illustration of a representative article of footwear with a layered sole structure having a multipiece midsole in accordance with aspects of the present disclosure.

The present disclosure is amenable to various modifications and alternative forms, and some representative embodiments are shown by way of example in the drawings and will be described in detail herein. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. Representative examples of the disclosure are shown in the drawings and will be described in detail herein with the understanding that these representative examples are provided as an exemplification of the disclosed principles, not limitations of the broad aspects of the disclosure. To that extent, elements and limitations that are described in the Abstract, Technical Field, Background, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including", "comprising", "having", "containing", and the like shall each mean "including without limitation." Moreover, words of approximation, such as "about," "almost", "generally", "substantially", "approximately", and the like, may be used herein in the sense of "at, near, or nearly at," or "within 0-5% of," or "within acceptable manufacturing tolerances", or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with a ground-engaging bottom surface of the sole structure seated on a flat surface, for example.

Figure 1B:
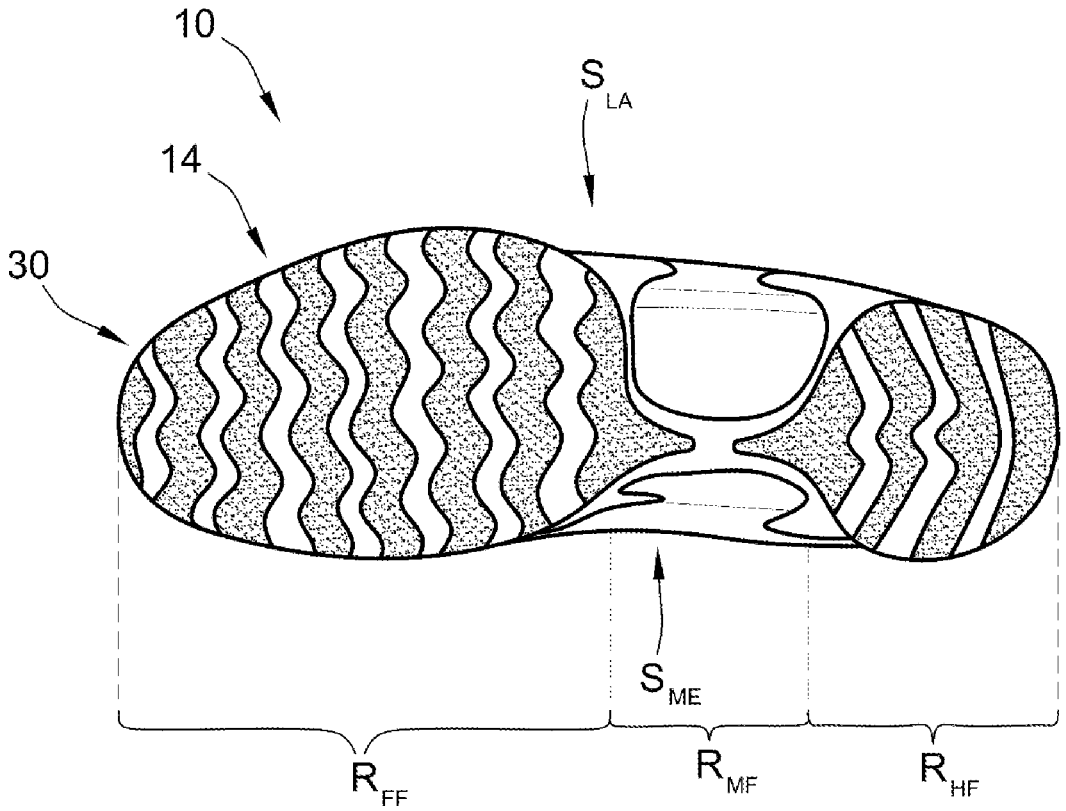
FIG. 1B is a bottom-view illustration of the representative article of footwear of FIG. 1A.

Referring now to the drawings, wherein like reference numbers refer to like features throughout the several views, there is shown in FIGS. 1A and 1B a representative article of footwear, which is designated generally at 10 and portrayed herein for purposes of discussion as an athletic shoe or "sneaker." The illustrated article of footwear 10—also referred to herein as "footwear" or "shoe" for brevity—is an exemplary application with which novel aspects and features of this disclosure may be practiced. In the same vein, implementation of the present concepts for a quadlayer, polymer sole structure assembly should also be appreciated as a representative implementation of the disclosed concepts. It will therefore be understood that aspects of this disclosure may be integrated into midsoles with additional layers, sole structures with different material compositions, and may be incorporated into any logically relevant type of footwear. As used herein, the terms "shoe" and "footwear," including permutations thereof, may be used interchangeably and synonymously to reference any suitable type of garment worn on a human foot. Lastly, features presented in the drawings are not necessarily to scale and are provided purely for instructional purposes. Thus, the specific and relative dimensions shown in the drawings are not to be construed as limiting.

The representative article of footwear 10 is generally depicted in FIGS. 1A and 1B as a bipartite construction that is primarily composed of a foot-receiving upper 12 mounted on top of a subjacent sole structure 14. For ease of reference, footwear 10 may be divided into three anatomical regions: a forefoot region $R_{FF}$, a midfoot region $R_{MF}$, and a hindfoot (heel) region $R_{HF}$, as shown in FIG. 1. Footwear 10 may also be divided along a vertical plane into: a lateral segment $S_{LA}$—a distal half of the shoe 10 farthest from the sagittal plane of the human body; and a medial segment $S_{ME}$—a proximal half of the shoe 10 closest to the sagittal plane of the human body. In accordance with recognized anatomical classification, the forefoot region $R_{FF}$ is located at the front of the footwear 10 and generally corresponds with the phalanges (toes), metatarsals, and any interconnecting joints thereof. Interposed between the forefoot and hindfoot regions $R_{FF}$ and $R_{HF}$ is the midfoot region $R_{MF}$, which generally corresponds with the cuneiform, navicular and cuboid bones (i.e., the arch area of the foot). Hindfoot region $R_{HF}$, in contrast, is located at the rear of the footwear 10 and generally corresponds with the talus (ankle) and calcaneus (heel) bones. Both lateral and medial segments $S_{LA}$ and $S_{ME}$ of the footwear 10 extend through all three anatomical regions $R_{FF}$, $R_{MF}$, $R_{HF}$, and each corresponds to a respective transverse side of the footwear 10. While only a single shoe 10 for a left foot of a user is shown in FIGS. 1A and 1B, a mirrored, substantially identical counterpart for a right foot of a user may be provided. Recognizably, the shape, size, material composition, and method of manufacture of the shoe 10 may be varied, singly or collectively, to accommodate practically any conventional or nonconventional footwear application.

With reference again to FIG. 1A, the upper 12 is depicted as having a shell-like closed toe and heel configuration for encasing a human foot. Upper 12 of FIG. 1A is generally defined by three adjoining sections, namely a toe box 12A, a vamp 12B and a rear quarter 12C. The toe box 12A is shown as a rounded forward portion of the upper 12 that extends from distal to proximal phalanges to cover and protect the user's toes. By comparison, the vamp 12B is an arched midsection of the upper 12 that is located aft of the toe box 12A and extends from the metatarsals to the cuboid. As shown, the vamp 12B also provides a series of lace eyelets 16 and a shoe tongue 18. Positioned aft of the vamp 12B is a rear quarter 12C that extends from the transverse tarsal joint to wrap around the calcaneus bone, and includes the rear end and rear sides of the upper 12. While portrayed in the drawings as comprising three primary segments, the upper 12 may be fabricated as a single-piece construction or may be composed of any number of segments, including a toe shield, heel cap, throat, ankle cuff, interior liner, etc. For sandal and slipper applications, the upper 12 may take on an open toe and/or open heel configuration or may be replaced with a single strap or multiple interconnected straps.

The upper 12 portion of the footwear 10 may be fabricated from any one or combination of a variety of materials, such as textiles, engineered foams, polymers, natural and synthetic leathers, etc. Individual segments of the upper 12, once assembled or cut to shape and size, may be stitched, adhesively bonded, fastened, welded or otherwise joined together to form an interior void for comfortably receiving a foot. The individual material elements of the upper 12 may be selected and located with respect to the footwear 10 in order to impart desired properties of durability, air-permeability, wear-resistance, flexibility, appearance, and comfort, for example. An ankle opening 15 in the rear quarter 12C of the upper 12 provides access to the interior of the shoe 10. A shoelace 20, strap, buckle, or other commercially available mechanism may be utilized to modify the girth of the upper 12 to more securely retain the foot within the interior of the shoe 10, as well as to facilitate foot entry and removal to/from the upper 12. Shoelace 20 may be threaded through a series of eyelets 16 in a lace cage section of the upper 12; the tongue 18 may extend between the lace 20 and the interior void of the upper 12.

Sole structure 14 is rigidly secured to the upper 12 such that the sole structure 14 extends between the upper 12 and a support surface upon which stands a user. In effect, the sole structure 14 functions as an intermediate support platform that separates and protects the user's foot from the ground. In addition to attenuating ground reaction forces and providing cushioning for the foot, sole structure 14 of FIGS. 1A and 1B may provide traction, impart stability, and help to limit various foot motions, such as inadvertent foot inversion and eversion. It is envisioned that the sole structure 14 may be attached to the upper 12 via any presently available or hereinafter developed suitable means. For at least some applications, the upper 12 may be coupled directly to the midsole 24 and, thus, lack a direct coupling to either the insole 22 or the outsole 26. By way of non-limiting example, the upper 12 may be adhesively attached to only an inside periphery of a midsole sidewall, e.g., secured with a 10 mm bonding allowance via priming, cementing, and pressing.

In accordance with the illustrated example, the sole structure 14 is fabricated as a sandwich structure with a foot-contacting insole 22 (FIG. 1A), an intermediate midsole 24, and a bottom-most outsole 26. Alternative sole structure configurations may be fabricated with greater or fewer than three layers. Insole 22 is located within an interior void of the footwear 10, operatively located at a lower portion of the upper 12, such that the insole 22 abuts a plantar surface of the foot. Underneath the insole 22 is a midsole 24 that incorporates one or more materials or embedded elements that enhance the comfort, performance, and/or ground-reaction-force attenuation properties of footwear 10. These elements and materials may include, individually or in any combination, a polymer foam material, such as polyurethane or ethylene-vinyl acetate (EVA), filler materials, moderators, air-filled bladders, plates, lasting elements, or motion control members. Outsole 26 is located underneath the midsole 24, defining some or all of the bottom-most, ground-engaging portion of the footwear 10. The outsole 26 may be formed from a natural or synthetic rubber material that provides a durable and wear-resistant surface for contacting the ground. In addition, the outsole 26 may be contoured and textured to enhance the traction (i.e., friction) properties between footwear 10 and the underlying support surface.

Figure 2:
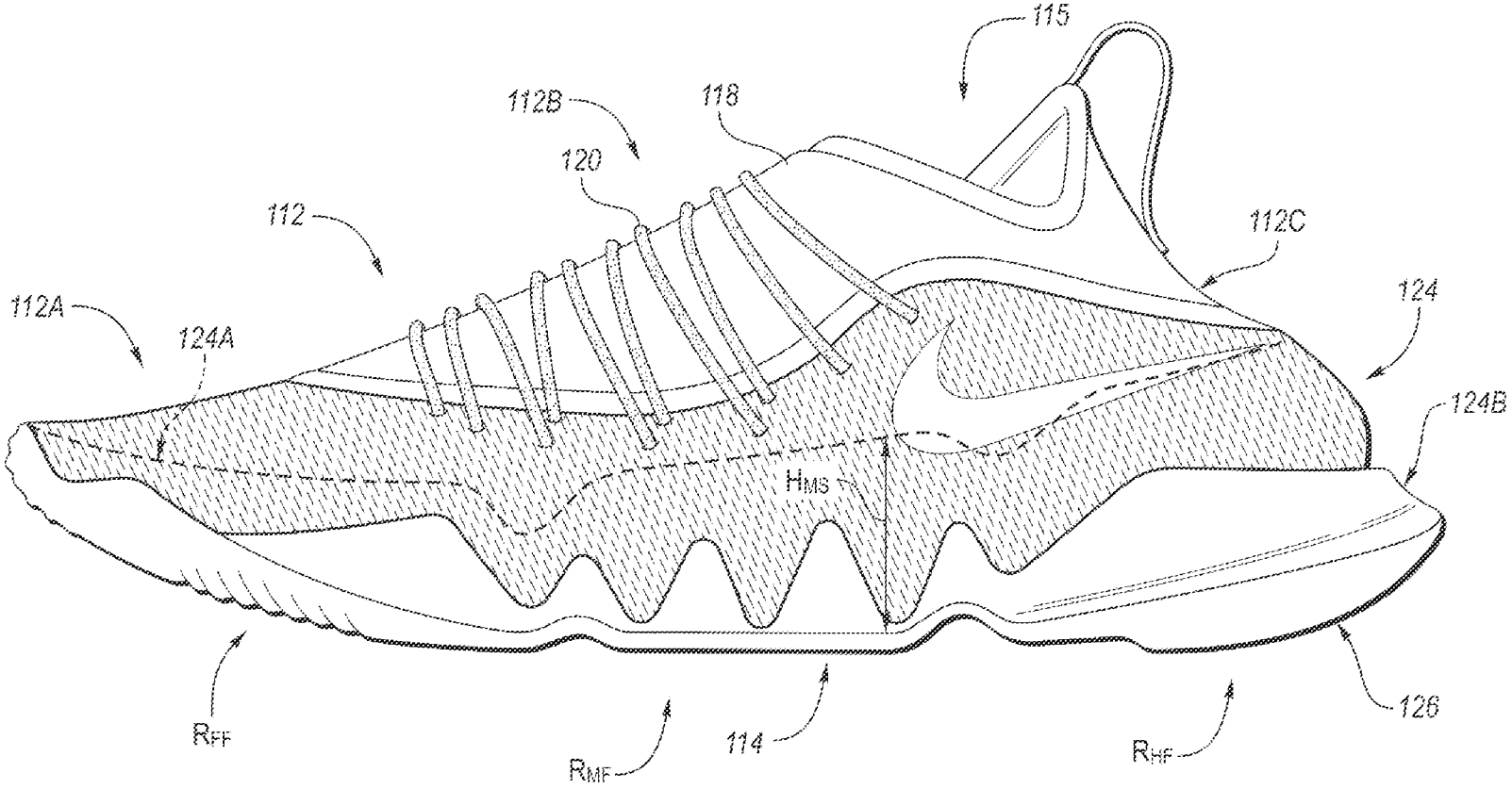
FIG. 2 is a lateral, side-view illustration of a representative athletic shoe with a layered sole structure assembly having a multipiece midsole with peripheral walls providing enhanced lateral stability in accord with aspects of the disclosed concepts.

With reference now to FIG. 2, there is shown another representative article of footwear, which is designated generally at 110 and portrayed herein for purposes of discussion as an athletic shoe of the basketball type. Although differing in appearance, the athletic shoe 110 of FIG. 2 may take on any of the features, options, and alternatives described above with respect to the footwear 10 presented in FIGS. 1A and 1B, and vice versa. For instance, the athletic shoe 110 of FIG. 2 includes a foot-securing upper 112 that is seated on top of a foot-supporting sole structure 114. Athletic shoe 110 is also assembled with a "mono-sock" tongue 118 that extends between a shoelace 120 and an interior foot-receiving void of the upper 112. A toe box section 112A extends from distal to proximal phalanges of the foot to cover and protect the user's toes. In addition, a vamp section 112B, which is located aft of the toe box 112A, extends from the metatarsals to the cuboid of the foot. An ankle opening 115 in a rear quarter portion 112C of the upper 112 provides access to the interior of the shoe 110.

Figure 3:
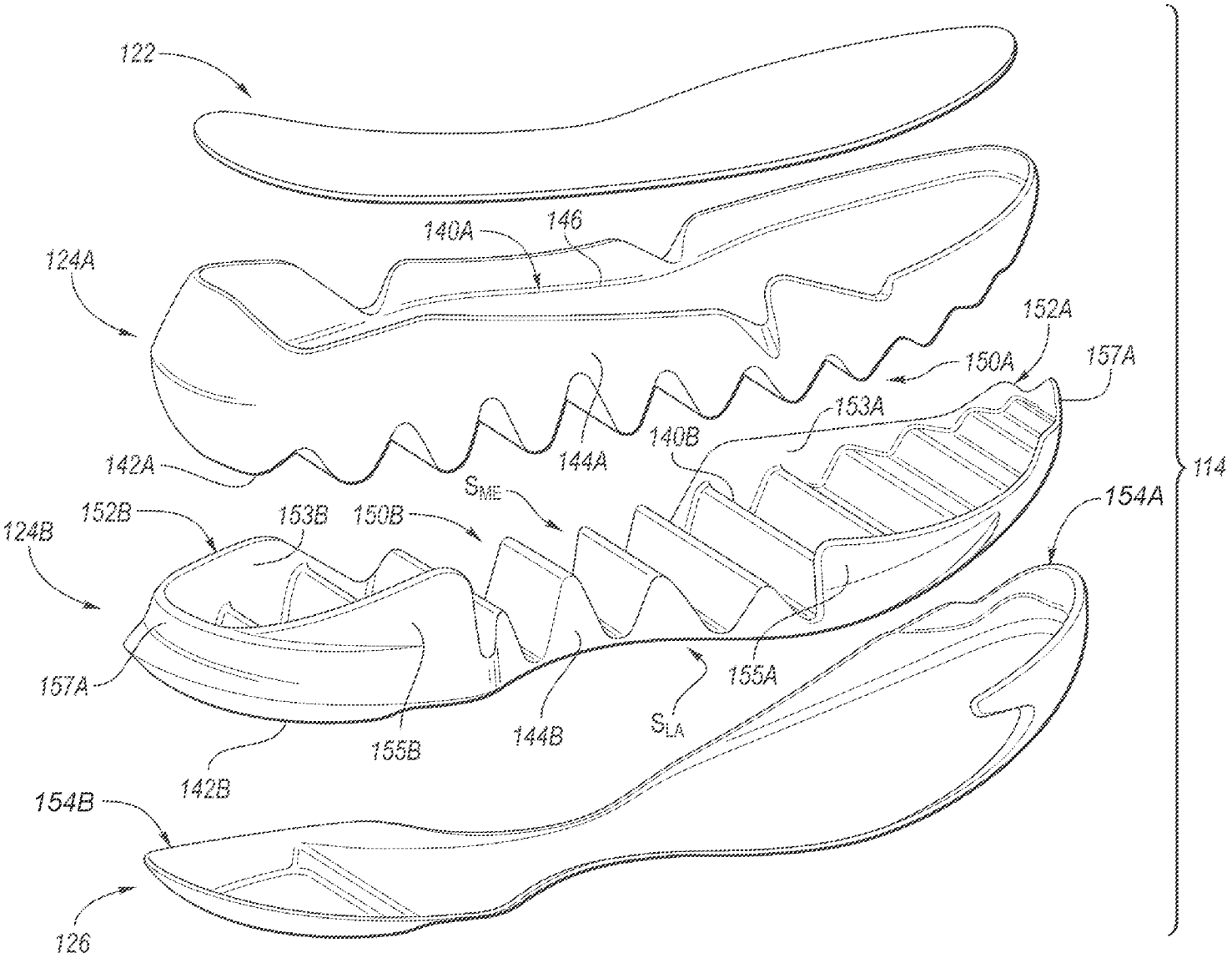
FIG. 3 is an exploded, perspective-view illustration of select components of the representative sole structure assembly of FIG. 2.
Figure 4:
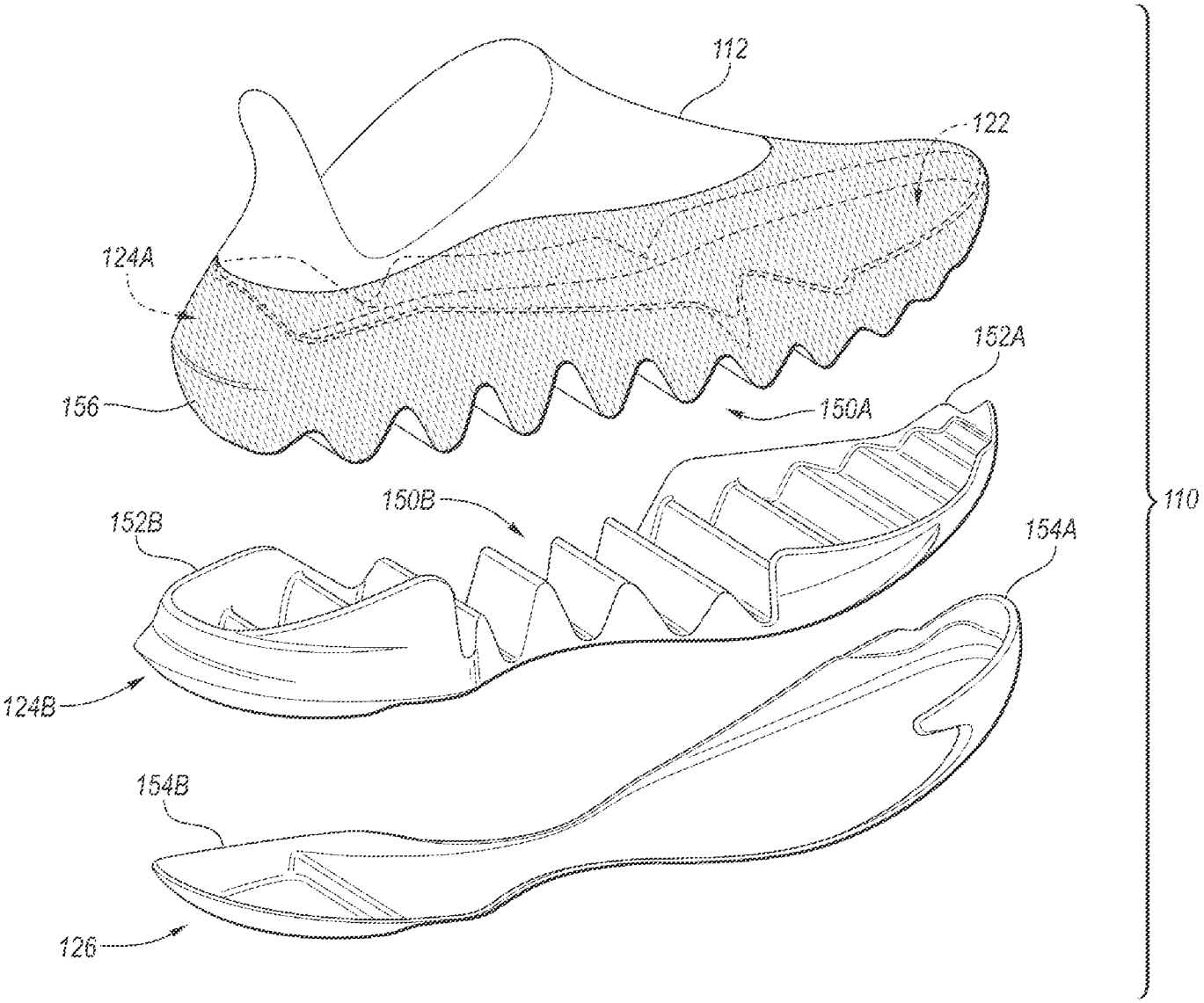
FIG. 4 is a partially exploded, perspective-view illustration of select components of the representative athletic shoe of FIG. 2.

Sole structure 114 of FIGS. 2 and 3, like sole structure 14 of FIGS. 1A and 1B, is a multilayer construction that is generally composed of a foot-cushioning, compressible insole 122, a multipiece, energy-preserving midsole 124, and a ground-contacting, traction-increasing outsole 126. The insole 122 is shown in FIGS. 3 and 4 located on an upward-facing, top surface of the midsole 124, seated within an insole pocket 146 recessed into a topmost (first) upper surface 140A of a top (first) midsole section 124A. At the opposite end of the sole structure 114 is the outsole 126, which is adhered, overlaid, fastened, or otherwise rigidly attached to a downward-facing, bottom surface of the midsole 124, covering an underside (second) lower surface 142B of a bottom (second) midsole section 124B subjacent the top midsole section 124A. While shown extending across and concealing the entire lower midsole surface 142B of midsole section 124B, it is envisioned that the outsole 126 may cover only select sections of the midsole 124 or, alternatively, may be removed entirely from the sole structure 114. The foregoing applies commensurately to the insole 122.

Each constituent part of the sole structure 114 may be cast, cut, injection molded, or otherwise constructed as a discrete, single-piece structure. The midsole sections 124A, 124B, for example, may be formed from distinct materials or may be formed from a common polymer foam, such as a closed-cell, cross-linked polyolefin foam or fluoropolymer. In other non-limiting examples, the midsole 124 may include a thermoplastic polyurethane (TPU) foam, Phylon, Phylite, or EVA. Contrastingly, the compressible insole 122 may be formed from a polymer or polymer foam that is distinct from the materials used to produce the midsole 124 and outsole 126. As shown, the insole 122 is molded from a softer polymer foam material, such as a lightweight polyurethane foam having a material hardness of about 20 to about 35 Shore A. The outsole 126, on the other hand, is fabricated from a polymer material that is harder than the polymer materials of the insole 122 and outsole 126. It may be desirable, for at least some applications, that the Shore A hardness of the outsole material be larger than the Shore A hardness of the midsole material, e.g., by at least about 20% and larger than the Shore A hardness of the insole material by at least about 50%. The outsole material may include an elastic polymer material, such as polyvinylchloride (PVC), hard-compound polyurethane (PU), or a polycaprolactone (PCL) or polyester-based TPU.

To optimize the sole structure 114 assembly's overall cushion feel and energy return during shoe impact, the illustrated midsole 124 is manufactured as a multipiece construction with a midsole height Hms that is about 30-40% larger than many conventional midsole designs. For at least some implementations, the vertical midsole height may be at least about 30-45 millimeters (mm) high in the hindfoot/heel region and at least about 18-25 mm high in the forefoot/toe region. In order to improve lateral stability of the athletic shoe 110—minimize inadvertent foot eversion and inversion during lateral gait—in light of this increased midsole height, the midsole is constructed as a mechanically interconnected, bipartite structure. According to the illustrated example, the midsole 124 is composed of a top (first) midsole section 124A and a bottom (second) midsole section 124B. The top midsole section 124A has opposing (first) upper and lower surfaces 140A and 142A, respectively, and an outboard-facing (first) sidewall 144A that extends between and adjoin the upper and lower surfaces 140A, 142A. Likewise, the bottom midsole section 124B has opposing (second) upper and lower surfaces 140B and 142B, respectively, and an outboard-facing (second) sidewall 144B that extends between and adjoin the upper and lower surfaces 140B, 142B. These sidewalls 144A and 144B extend in a continuous manner around the peripheral boundary of the shoe structure 114, individually defining the transverse perimeter of their respective midsole section 124A, 124B, and collectively defining the transverse perimeter of the midsole 124.

With collective reference to FIGS. 3 and 4, the top and bottom midsole sections 124A, 124B are mechanically connected with each other, at least in part, through meshing engagement between juxtaposed structural features of their interfacing surfaces. In accord with the illustrated example, the first midsole section's 124A lower surface 142A is fabricated with a non-planar (first) waveform geometry 150A, and the second midsole section's 124B upper surface 140B is fabricated with a non-planar (second) waveform geometry 150B. When the first and second midsole sections 124A, 124B are properly mated, the downward-facing waveform geometry 150A seats in and intermeshes with the upward-facing waveform geometry 150B. In particular, the peaks of the intermeshed waveforms interleave with one another in an alternating fashion, with the peaks of the first waveform geometry 150A sitting flush within the valleys of the second waveform geometry 150B, and vice versa. Recognizably, the number, shape and size of peaks and valleys in each waveform geometry may be varied from that which are shown in the drawings, e.g., to accommodate different shoe sizes and/or performance functions.

Both waveform geometries 150A, 150B are portrayed in the Figures as anteroposterior-undulating curviform waves, namely sinusoids propagating in a fore-aft direction relative to the athletic shoe 110. The downward-facing waveform geometry 150A extends all the way from the forward most edge of the first midsole section 124A to the rearward most edge thereof. Comparatively, the upward-facing waveform geometry 150B extends between, but not to, the fore and aft edges of the second midsole section 124B. Both anteroposterior-undulating curviform waves have damped sinusoidal longitudinal cross sections, as best seen in the side-view illustration of FIG. 2. A "damped" sinusoid, as used herein, may be typified as a sine wave with a variable amplitude that departs from and/or approaches zero in the longitudinal direction of the sole structure 114. In addition to having variable amplitudes, the waveforms are also shown with variable frequencies, i.e., the number of oscillations per incremental fore-aft length changes in the longitudinal direction of the sole structure 114. It can also be seen that the mediolateral (transverse) widths of the waveforms are widest in the forefoot region $R_{FF}$, narrowest in the midfoot region $R_{MF}$, and of intermediate width in the hindfoot region $R_{HF}$. Irrespective of desired shape and relative arrangement of parts, the waveform geometries 150A, 150B complement each other such that the first midsole section's 124A lower surface 142A sits substantially flush against the second midsole section's 124B upper surface 140B.

To provide additional lateral reinforcement for the multipiece midsole 124 assembly during use of the shoe 110, the bottom midsole section 124B includes one or more peripheral "retaining" walls that extend upward from the sidewall 144B into abutting relation with the top midsole section 124A, such as sidewall 144A. It may be desirable, for at least some implementations, that this peripheral wall be a one-piece element that extends in a continuous or substantially continuous manner around the entire periphery of the midsole 124. Alternatively, the peripheral wall may be composed of discrete wall elements, such as integrally formed front (first) and back (second) peripheral walls 152A and 152B, respectively. The front peripheral wall 152A extends upward from the forefoot region $R_{FF}$ of the sidewall 144B, whereas the back peripheral wall 152B is longitudinally spaced from the front peripheral wall 152A and extends upward from the hindfoot region $R_{HF}$ of the sidewall 144B. It is envisioned that the number, location and orientation of the bottom midsole section's 124B peripheral wall or walls may be varied, singly or collectively, from the illustrated example. As a further option, the top midsole section 124A may include one or more peripheral walls that extend downward from the sidewall 144A into abutting relation with the bottom midsole section 124B, such as sidewall 144B to increase lateral reinforcement for the multipiece midsole 124.

With reference again to FIG. 3, the front peripheral wall 152A has a distinct arcuate shape that extends from a medial side $S_{ME}$ to a lateral side $S_{LA}$ of the bottom midsole section 124B, wrapping around the toe box region of the top midsole section 124A. This peripheral wall 152A is generally composed of a first medial wall 153A, a first lateral wall 155A that is distinctly shaped and sized from the first medial wall 153A, and a toe wall 157A that extends between and adjoins the medial and lateral walls 153A, 155A. In contrast, the rear peripheral wall 152B has a distinct arcuate shape that is dissimilar to the front peripheral wall's 152A arcuate shape. As shown, the rear peripheral wall 152B extends from the medial side $S_{ME}$ to the lateral side $S_{LA}$ of the midsole section 124B, wrapping around the heel counter region of the midsole section 124A. This peripheral wall 152B is generally composed of a second medial wall 153B, a second lateral wall 155B that is distinctly shaped and sized from the second medial wall 153B, and a heel wall 157B that extends between and adjoins the medial and lateral walls 153B, 155B. In addition to buttressing the top midsole section 124A, the peripheral walls 152A, 152B also cover a majority of the wave seam extending across the midsole 124, as seen in the side-view of FIG. 2.

As an optional lateral reinforcement feature, the outsole 126 may include a front (first) flanged peripheral wall 154A that extends upward from the outsole's perimeter in the forefoot region $R_{FF}$ of the sole structure 114. Optionally or alternatively, the outsole 126 may include a back (second) flanged peripheral wall 154B that extends upward from the outsole's perimeter in the hindfoot region $R_{HF}$ of the sole structure 114. Inboard-facing surfaces of these flanged peripheral walls 154A, 154B sit flush against respective outboard-facing surfaces of the second midsole section 124B, such as front and back peripheral walls 152A, 152B. Similar to the peripheral walls 152A, 152B of the midsole 124, it is envisioned that the number, location and orientation of the outsole's 126 flanged peripheral walls 154A, 154B may be varied from the illustrated example.

In addition to the features described above for increasing the lateral stability of the athletic shoe 110 in light of the heightened sole structure 114 assembly, an optional flexible sheet 156 (FIG. 4) is sandwiched between the two midsole sections 124A, 124B. The sheet 156 may take on various suitable materials and forms; however, in the illustrated example, the flexible sheet 156 is a substantially flat textile material that is lasted into a shoe-shaped geometry. The term "textile", as used herein, may refer to a fabric or cloth that is formed from natural or synthetic fibers by knitting, weaving, crocheting, braiding, bonding, lacing, or any other suitable process for textile production. A textile material may be composed of one or more of organic fibers, such as animal-based and plant-based fibers, one or more synthetic fibers, such as polymer-based and glass-based fibers, and/or one or more metal-based fibers, such as silver, gold, or aluminum filaments and aluminized yarns. Textile materials made using a combination of these methods and/or materials could have portions that incorporate multiple structures, for example: a knitted portion formed using braided fibers; fibers woven through a knitted or crocheted structure, e.g., to provide dimensional strength and/or stabilization; a crocheted edge formed on a knitted or woven structure; woven layers knitted together to form a multi-layer textile material such as a 3D textile material, etc. Some textile materials include more than one type of fiber, as well as a blended fiber, such as an animal/synthetic blended fiber, an animal/plant blended fiber, a glass/polymer blended fiber (fiberglass), etc., and any combination thereof.

The flexible sheet 156 is shown extending across and covering substantially all of the lower surface 142A of the top midsole section 124A and the upper surface 140B of the bottom midsole section 124B. This flexible sheet 156 may rigidly attach to the footwear's upper 112; alternatively, flexible sheet 156 forms a section of the upper 112. As shown, the flexible sheet 156 wraps arounds, contacts, and rigidly attaches to the sidewall 144A and lower surface 142A such that the top midsole section 124A is generally encased within the flexible sheet 156, as seen in FIG. 4. While shown as a section of the upper 112, the flexible sheet 156 may take on alternative configurations, including a dedicated scrim, a portion of a strobel, etc. Additional information related to a sheet material incorporated into a split midsole structure is available in commonly owned International (PCT) Patent Application Pub. No. WO 2019/046438 A1, which is incorporated herein by reference in its entirety.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features. Additional features may be reflected in the following clauses:

Clause 1: a sole structure for an article of footwear, the sole structure comprising: a first midsole section including opposing first upper and lower surfaces and a first sidewall extending between and adjoining the first upper and lower surfaces, the first lower surface having a first waveform geometry; a second midsole section including opposing second upper and lower surfaces and a second sidewall extending between and adjoining the second upper and lower surfaces, the second upper surface having a second waveform geometry seating therein and intermeshing with the first waveform geometry of the first midsole section, the second midsole section including a peripheral wall extending upward from the second sidewall and abutting the first sidewall; and an outsole attached to the second lower surface of the second midsole section and including a ground-contacting surface.

Clause 2: the sole structure of clause 1, wherein the peripheral wall includes a first peripheral wall extending upward from a forefoot region of the second sidewall, and a second peripheral wall spaced from the first peripheral wall and extending upward from a hindfoot region of the second sidewall.

Clause 3: the sole structure of clause 2, wherein the first peripheral wall has a first arcuate shape extending from a medial side to a lateral side of the second midsole section around a toe box region of the first midsole section, and the second peripheral wall has a second arcuate shape, distinct from the first arcuate shape, extending from the medial side to the lateral side of the second midsole section around a heel counter region of the first midsole section.

Clause 4: the sole structure of clause 3, wherein the first peripheral wall includes a first medial wall, a first lateral wall distinctly shaped from the first medial wall, and a toe wall extending between and adjoining the first medial and lateral walls, and the second peripheral wall includes a second medial wall, a second lateral wall distinctly shaped from the second medial wall, and a heel wall extending between and adjoining the second medial and lateral walls.

Clause 5: the sole structure of any one of clauses 1 to 4, wherein the outsole includes a flanged peripheral wall extending upward from a perimeter of the outsole, an inboard surface of the flanged peripheral wall abutting an outboard surface of the peripheral wall of the second midsole section.

Clause 6: the sole structure of any one of clauses 1 to 5, further comprising a flexible sheet interposed between the first and second midsole sections and extending across the first lower surface and the second upper surface.

Clause 7: the sole structure of clause 6, wherein the flexible sheet wraps around, contacts, and rigidly attaches to the first sidewall and first lower surface with the first midsole section nested within the flexible sheet.

Clause 8: the sole structure of clause 7, wherein the article of footwear includes an upper configured to receive therein and attach to a foot of a user, and wherein the flexible sheet is configured to rigidly attach to and/or form a section of the upper.

Clause 9: the sole structure of any one of clauses 1 to 8, wherein the first waveform geometry includes a first anteroposterior-undulating curviform wave extending from fore to aft edges of the first midsole section, and the second waveform geometry includes a second anteroposterior-undulating curviform wave extending between fore and aft edges of the second midsole section.

Clause 10: the sole structure of clause 9, wherein the first and second anteroposterior-undulating curviform waves have complementary first and second damped sinusoidal longitudinal cross sections, respectively, such that the first lower surface sits substantially flush against the second upper surface.

Clause 11: the sole structure of any one of clauses 1 to 10, wherein the first midsole section is molded as a first single-piece structure from a first polymer foam, and the second midsole section is molded as a second single-piece structure from a second polymer foam.

Clause 12: the sole structure of clause 11, further comprising a compressible insole seated in an insole pocket recessed into the first upper surface of the first midsole section.

Clause 13: the sole structure of clause 12, wherein the first and second polymer foams are a cross-linked polyolefin foam, the compressible insole is fabricated from a third polymer foam distinct from the first and second polymer foams, and the outsole is fabricated from a fourth polymer material harder than the first, second and third polymer foams.

Clause 14: an article of footwear for a foot of a user, the article of footwear comprising: an upper attached configured to receive and attach to the foot of the user; a sole structure attached to the upper and configured to support thereon the foot of the user, the sole structure including: a first midsole section with opposing first upper and lower surfaces and a first sidewall extending between and adjoining the first upper and lower surfaces, the first lower surface having a first waveform geometry; a second midsole section with opposing second upper and lower surfaces and a second sidewall extending between and adjoining the second upper and lower surfaces, the second upper surface having a second waveform geometry seating therein and intermeshing with the first waveform geometry, the second midsole section including a peripheral wall extending upward from the second sidewall and abutting the first sidewall; and an outsole mounted to the second lower surface of the second midsole section and including a ground-contacting surface of the article of footwear.

Clause 15: a method for constructing a sole structure for an article of footwear, the footwear including an upper configured to receive a foot of a user, the method comprising: forming, using a first polymer foam material, a first midsole section including opposing first upper and lower surfaces and a first sidewall extending between and adjoining the first upper and lower surfaces, the first lower surface having a first waveform geometry; forming, using a second polymer foam material, a second midsole section including opposing second upper and lower surfaces and a second sidewall extending between and adjoining the second upper and lower surfaces, the second upper surface having a second waveform geometry, and the second midsole section including a peripheral wall extending upward from the second sidewall; seating the first midsole section on the second midsole section with the second waveform geometry intermeshing the first waveform geometry of the first midsole section and the peripheral wall abutting the first sidewall; and attaching an outsole to the second lower surface of the second midsole section, the outsole including a ground-contacting surface of the article of footwear.

Clause 16: the method of clause 15, wherein the peripheral wall includes a first peripheral wall extending upward from a forefoot region of the second sidewall, and a second peripheral wall spaced from the first peripheral wall and extending upward from a hindfoot region of the second sidewall.

Clause 17: the method of clause 16, wherein the first peripheral wall has a first arcuate shape extending from a medial side to a lateral side of the second midsole section around a toe box region of the first midsole section when the first midsole section is seated on the second midsole section, and the second peripheral wall has a second arcuate shape, distinct from the first arcuate shape, extending from the medial side to the lateral side of the second midsole section around a heel counter region of the first midsole section.

Clause 18: the method of clause 17, wherein the first peripheral wall includes a first medial wall, a first lateral wall distinctly shaped from the first medial wall, and a toe wall extending between and adjoining the first medial and lateral walls, and the second peripheral wall includes a second medial wall, a second lateral wall distinctly shaped from the second medial wall, and a heel wall extending between and adjoining the second medial and lateral walls.

Clause 19: the method of any one of clauses 15 to 18, wherein the outsole includes a flanged peripheral wall extending upward from a perimeter of the outsole, an inboard surface of the flanged peripheral wall abutting an outboard surface of the peripheral wall of the second midsole section when the outsole is attached to the second lower surface of the second midsole section.

Clause 20: the method of any one of clauses 15 to 19, further comprising placing a flexible sheet between the first and second midsole sections with the flexible sheet extending across the first lower surface and the second upper surface.

Clause 21: the method of clause 20, further comprising wrapping the flexible sheet around and rigidly attaching the flexible sheet to the first sidewall and first lower surface with the first midsole section nested within the flexible sheet.

Clause 22: the method of clause 21, wherein the article of footwear includes an upper configured to receive therein and attach to a foot of a user, further comprising rigidly attaching the flexible sheet to and/or forming the flexible sheet as a section of the upper.

Clause 23: the method of any one of clauses 15 to 22, wherein the first waveform geometry includes a first anteroposterior-undulating curviform wave extending from fore to aft edges of the first midsole section, and the second waveform geometry includes a second anteroposterior-undulating curviform wave extending between fore and aft edges of the second midsole section.

Clause 24: the method of clause 23, wherein the first and second anteroposterior-undulating curviform waves have complementary first and second damped sinusoidal longitudinal cross sections, respectively, such that the first lower surface sits substantially flush against the second upper surface.

Clause 25: the method of any one of clauses 15 to 24, wherein the first midsole section is molded as a first single-piece structure from a first polymer foam, and the second midsole section is molded as a second single-piece structure from a second polymer foam.

What is claimed:

1. A sole structure for an article of footwear, the sole structure comprising:

a first midsole section including a first upper surface, a first lower surface opposite the first upper surface, and a first sidewall extending between and adjoining the first upper and lower surfaces, the first lower surface having a first waveform geometry;

a second midsole section including a second upper surface, a second lower surface opposite the second upper surface, and a second sidewall extending between and adjoining the second upper and lower surfaces, the second upper surface having a second waveform geometry seating therein and intermeshing with the first waveform geometry of the first midsole section, the second midsole section including a plurality of peripheral walls spaced along an outer perimeter of the second midsole section, separated from each other via wall gaps, and projecting upward from the second sidewall adjacent the first sidewall;

a flexible sheet interposed between the first and second midsole sections, the flexible sheet extending across the first lower surface and the second upper surface, wrapping around the first sidewall, and contacting interior surfaces of the peripheral walls; and an outsole attached to the second lower surface of the second midsole section and including a ground-contacting surface.

2. The sole structure of claim 1, wherein the flexible sheet sits flush against and covers substantially all of the first lower surface and the second upper surface.

3. The sole structure of claim 2, wherein the flexible sheet sits flush against and covers substantially all of the first sidewall such that the first midsole section nests within the flexible sheet.

4. The sole structure of claim 1, wherein the flexible sheet is configured to rigidly attach to an upper of the article of footwear, the upper configured to receive and attach to a foot of a user.

5. The sole structure of claim 1, wherein the peripheral walls include first and second peripheral walls, the first peripheral wall extending upward from a forefoot region of the sole structure, the second peripheral wall extending upward from a hindfoot region of the sole structure, and the wall gaps located in a midfoot region of the sole structure.

6. The sole structure of claim 5, wherein the first peripheral wall includes a first medial wall, a first lateral wall distinctly shaped from the first medial wall, and a toe wall extending between and adjoining the first medial and lateral walls, and the second peripheral wall includes a second medial wall, a second lateral wall distinctly shaped from the second medial wall, and a heel wall extending between and adjoining the second medial and lateral walls.

7. The sole structure of claim 1, wherein the peripheral walls are integral with the second sidewall and the second waveform geometry.

8. The sole structure of claim 1, wherein the outsole includes a flanged peripheral wall extending upward from a perimeter of the outsole, an inboard surface of the flanged peripheral wall abutting an outboard surface of the second midsole section.

9. The sole structure of claim 1, wherein the first waveform geometry includes a first anteroposterior-undulating curviform wave extending from fore to aft edges of the first midsole section, and the second waveform geometry includes a second anteroposterior-undulating curviform wave extending between fore and aft edges of the second midsole section.

10. The sole structure of claim 1, wherein the first midsole section is molded as a first single-piece structure from a first polymer foam, and the second midsole section is molded as a second single-piece structure from a second polymer foam.

11. The sole structure of claim 1, further comprising a compressible insole seated in an insole pocket recessed into the first upper surface of the first midsole section.

12. An article of footwear for a foot of a user, the article of footwear comprising:

an upper configured to receive and attach to the foot of the user; and a sole structure attached to the upper and configured to support thereon the foot of the user, the sole structure including:

a first midsole section formed from a first polymer material and including a first upper surface, a first lower surface opposite the first upper surface, and a first sidewall extending between and adjoining the first upper and lower surfaces, the first lower surface having a first waveform geometry;

a second midsole section formed from a second polymer material and including a second upper surface, a second lower surface opposite the second upper surface, and a second sidewall extending between and adjoining the second upper and lower surfaces, the second upper surface having a second waveform geometry seating therein and intermeshing with the first waveform geometry of the first midsole section, the second midsole section including a plurality of peripheral walls spaced along an outer perimeter of the second midsole section, separated from each other via wall gaps, and projecting upward from the second sidewall adjacent the first sidewall;

a flexible sheet formed from a textile material and interposed between the first and second midsole sections, wherein the flexible sheet extends across and covers substantially all of the first lower surface and the second upper surface, wraps around and covers substantially all of the first sidewall, and contacts interior surfaces of the peripheral walls of the second midsole section; and an outsole attached to the second lower surface of the second midsole section and including a ground-contacting surface.

13. A method for constructing a sole structure for an article of footwear, the method comprising:

forming a first midsole section including a first upper surface, a first lower surface opposite the first upper surface, and a first sidewall extending between and adjoining the first upper and lower surfaces, the first lower surface having a first waveform geometry;

forming a second midsole section including a second upper surface, a second lower surface opposite the second upper surface, and a second sidewall extending between and adjoining the second upper and lower surfaces, the second upper surface having a second waveform geometry, and the second midsole section including a plurality of peripheral walls spaced along an outer perimeter of the second midsole section, separated from each other via wall gaps, and projecting upward from the second sidewall adjacent the first sidewall;

placing a flexible sheet on the first lower surface of the first midsole section;

wrapping the flexible sheet around the first sidewall and the first lower surface such that the first midsole section is nested within the flexible sheet;

rigidly attaching the flexible sheet to the first midsole section;

seating the first midsole section on the second midsole section with the second waveform geometry intermeshing the first waveform geometry, the flexible sheet extending across the second upper surface, and inboard surfaces of the peripheral walls abutting outboard surfaces of the flexible sheet covering the first sidewall; and attaching an outsole to the second lower surface of the second midsole section, the outsole including a ground-contacting surface of the article of footwear.

14. The method of claim 13, wherein the flexible sheet sits flush against and covers substantially all of the first lower surface and the second upper surface.

15. The method of claim 14, wherein the flexible sheet sits flush against and covers substantially all of the first sidewall such that the first midsole section nests within the flexible sheet.

16. The method of claim 15, wherein the flexible sheet is configured to rigidly attach to an upper of the article of footwear, the upper configured to receive and attach to a foot of a user.

17. The method of claim 13, wherein the peripheral walls include a first peripheral wall extending upward from a forefoot region of the sole structure, and a second peripheral wall extending upward from a hindfoot region of the sole structure, and wherein the wall gaps are located in a midfoot region of the sole structure.

18. The method of claim 17, wherein the first peripheral wall includes a first medial wall, a first lateral wall distinctly shaped from the first medial wall, and a toe wall extending between and adjoining the first medial and lateral walls, and the second peripheral wall includes a second medial wall, a second lateral wall distinctly shaped from the second medial wall, and a heel wall extending between and adjoining the second medial and lateral walls.

19. The method of claim 13, wherein the first waveform geometry includes a first anteroposterior-undulating curviform wave extending from fore to aft edges of the first midsole section, and the second waveform geometry includes a second anteroposterior-undulating curviform wave extending between fore and aft edges of the second midsole section.

20. The method of claim 13, wherein the first midsole section is molded as a first single-piece structure from a first polymer foam, and the second midsole section is molded as a second single-piece structure from a second polymer foam.

* * * * *